United States Patent [19]

Röck et al.

[11] Patent Number: 4,543,686

[45] Date of Patent: Oct. 1, 1985

[54] FURNITURE HINGE HAVING A SPRING BIASED PIVOTING PRESSURE MEMBER

[75] Inventors: Erich Röck, Höchst; Klaus Brütle, Lauterach, both of Austria

[73] Assignee: Julius Blum Gesellschaft m.b.H., Höchst, Austria

[21] Appl. No.: 511,749

[22] Filed: Jul. 7, 1983

[30] Foreign Application Priority Data

| | | | |
|---|---|---|---|
| Jul. 16, 1982 | [AT] | Austria | 2775/82 |
| Apr. 22, 1983 | [AT] | Austria | 1484/83 |
| May 3, 1983 | [AT] | Austria | 1610/83 |

[51] Int. Cl.[4] ..... E05F 1/12

[52] U.S. Cl. ..... 16/288; 16/291; 16/294; 16/302; 16/347

[58] Field of Search ..... 16/50, 72, 76, 288, 16/291, 292, 293, 294, 295, 296, 297, 302, 333, 343, 345, 347, 370

[56] References Cited

U.S. PATENT DOCUMENTS

| | | | |
|---|---|---|---|
| 4,114,237 | 9/1978 | Grass | 16/294 |
| 4,152,811 | 5/1979 | Lautenschlager | 16/294 |
| 4,347,644 | 9/1982 | Lautenschläger et al. . | |

FOREIGN PATENT DOCUMENTS

| | | | |
|---|---|---|---|
| 2408057 | 8/1975 | Fed. Rep. of Germany | 16/294 |
| 2516084 | 10/1976 | Fed. Rep. of Germany . | |
| 2616570 | 1/1977 | Fed. Rep. of Germany | 16/294 |

*Primary Examiner*—Fred A. Silverberg

*Attorney, Agent, or Firm*—Wenderoth, Lind & Ponack

[57] ABSTRACT

A hinge with a closing mechanism includes a hinge arm connected with a hinge casing by two hinge links. The internal hinge link is a two-arm lever pivotable around a hinge axle on the hinge arm. A pressure member is pivotably mounted on an arm of the internal hinge link which extends into the hinge arm, such pressure member pressing on a pressure surface on the hinge arm.

7 Claims, 8 Drawing Figures

FURNITURE HINGE HAVING A SPRING BIASED PIVOTING PRESSURE MEMBER

FIELD AND BACKGROUND OF THE INVENTION

The invention relates to a hinge for a use on an article of furniture and having a closing mechanism. A hinge casing is mounted at the side of the door and pivotally mounts inner ends of two hinge links the outer ends of which engage a hinge arm, thereby forming a hinge quadrangle. A pressure member pre-stressed by spring pressure is mounted within the hinge arm, pivotally on the internal hinge link, abuts in the closed position of the hinge against the hinge axle of the external hinge link at the side of the hinge arm, and abuts in the open position against a preferably concave support surface on the hinge arm.

DESCRIPTION OF THE PRIOR ART

Such hinges having a separate closing mechanism are well known. It is their essential advantage that a separate closing member, e.g. a magnetic catch member, is not necessary on the piece of furniture.

Closing mechanism generally are formed such that the closed door is retained by the hinge so that, when the door is opened, the spring pressure of the closing mechanism must be acted against and when a dead center position has been overcome, the door is pressed outwardly by the closing mechanism, i.e. into the open position.

When the door is closed, the closing mechanism operates in a reverse manner.

It is the main disadvantages of such hinges that the closing effect of the hinge substantially starts when the door is in a 45°-open position. That is, the door is closed relatively early, namely at a time when the actual effect of the hinge and of the closing mechanism is not yet desired. Moreover, the doors of the article of furniture are often banged because of the long effective closing path, thus causing undesired noise and, furthermore, creating disadvantages with respect to high stresses acting on the axles and links of the hinge.

SUMMARY OF THE INVENTION

It is the object of the invention to provide a hinge of the afore-mentioned kind in which the angle of the furniture door to the actual closing plane of the furniture door during which the closing effect occurs can be freely selected and can be relatively small, preferably an angle of between 10° and 15°. Hence, neither when opening nor when closing the door need a dead center in the hinge be overcome. Furthermore, the closing mechanism in the hinge according to the invention is accommodated in the hinge arm in a very compact manner.

According to the invention this is achieved by designing the internal hinge link as a two-arm lever and by mounting the pressure member outside the two hinge axles of the hinge link at the hinge link.

It is advantageously provided that an arm of the internal hinge link extends into the hinge arm and that the pressure member is pivotally mounted on such arm.

An embodiment of the invention provides that the pressure member is acted upon by a leg spring mounted on the arm extending into the hinge arm or that the pressure member is the leg of a leg spring pivotally mounted on the arm of the hinge link extending into the hinge arm.

By using a leg spring high functional safety is obtained by simple means since the leg spring can, unlike a coil spring, be easily anchored in the hinge arm without requiring any guide means. Moreover, an additional pressure member in the closing mechanism need not be provided.

A further embodiment provides that a separate insert member is arranged on the hinge arm, such insert member extending over the total displacement path of the pressure member and having a pressure surface designed as the guide surface for the pressure member. Hence, the hinge arm need not be specially manufactured for the closing mechanism.

BRIEF DESCRIPTION OF THE DRAWINGS

In the following embodiments of the invention will be described in more detail with reference to the attached drawings, in which.

DETAILED DESCRIPTION OF THE INVENTION

Figure 1:
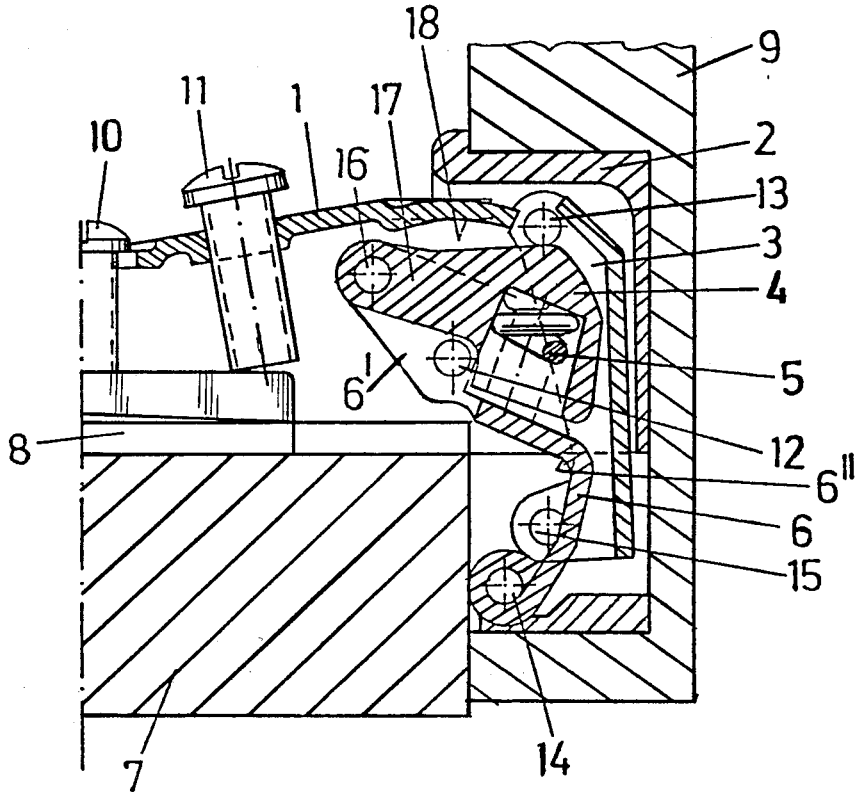
FIG. 1 is a sectional view of a hinge according to the invention, shown in the closed position.
Figure 2:
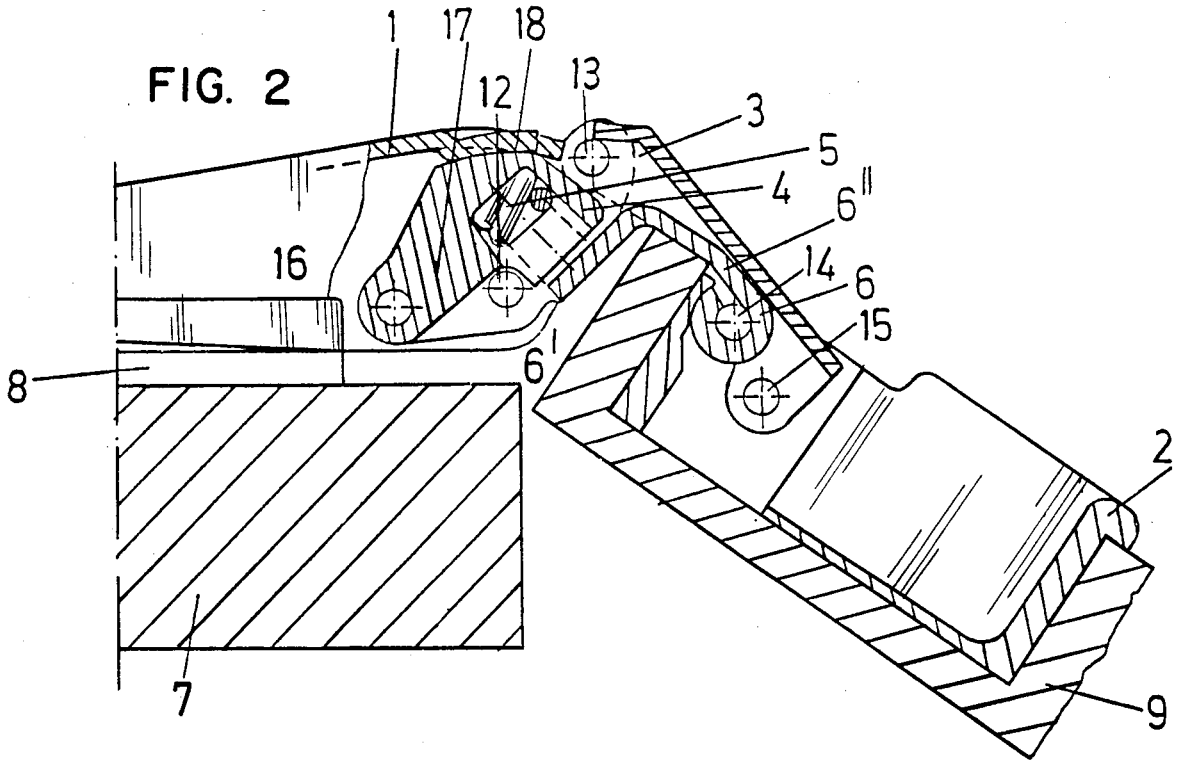
FIG. 2 is a similar sectional view of the hinge of FIG. 1 according to the invention, shown in the open position.

As can be seen from drawings, the hinge according to the invention has a hinge arm 1 fastened to a furniture side wall 7 by means of a base plate 8. The base plate 8 is fastened at the furniture side wall 7 in a conventional manner by means of screws or dowels. The hinge arm 1 is retained on the base plate 8 by means of a clamping screw 10. An adjusting screw 11 for the adjustment of the joint is also provided on the hinge, such adjusting screw being mounted in a female thread in the hinge arm 1 and abutting against the base plate 8. A hinge casing 2 of a hinge is inserted into a recess in a door 9.

The hinge arm 1 is connected with the hinge casing 2 by means of outer and inner hinge links 3, 6, respectively, mounted on hinge axles 13, 12 on the hinge arm 1 and on hinge axles 15, 14 in the hinge casing 2.

The internal hinge link 6 is in the form of a two-arm lever pivoting around the hinge axle 12 of the hinge arm 1. At the free end of one arm 6' of the hinge link 6, i.e. at a position on a side of hinge axle 12 opposite hinge axle 14, a pressure member 4 with a holding arm 17 is mounted on a bolt or axle 16. The pressure member 4 tends to pivot around the bolt 16, but a pivoting motion is not possible because the path of the pressure member 4 is limited by the hinge link axle 13 and by a support or guide surface 18 on the hinge arm 1. In the embodiment according to FIGS. 1, 2 and 6, 7, 8 the pressure member 4 has a holding arm 17.

In the embodiments according to FIGS. 1, 2 and 6, 7, 8 the pressure member 4 receives a pressure spring 5 abutting against the internal hinge link 6, namely at a position between the hinge link axles 12 and 14, i.e. on a second hinge link arm 6''.

Due to the arrangement according to the invention a contact surface of the pressure member 4 abuts in the closed position of the door 9 against the hinge link axle 13 and presses the internal hinge link 6 into the closing direction, i.e. the door 9 is held in the closed position.

When the door is opened or is moving in the opening direction, the contact surface of the pressure member 4 moves in the embodiments according to FIGS. 1, 2 and 6, 7, 8 from the hinge axle 13 to the stop surface 18 on the hinge arm, but no torque is imported by the pressure spring 5, i.e. the pressure member 4 and the pressure spring 5 are equally tensioned.

When the door 9 is closed, the pressure member 4 moves back to the hinge axle 13, but the tensioning condition of the pressure spring 5 is not changed. That is, with the hinge according to the invention, the person using the piece of furniture need not tension the pressure spring either when closing or when opening the hinge, and no banging of the door 9 occurs. It is obvious that no dead center must be overcome, but that nevertheless the door 9 is absolutely securely held in the closed position by the pressure spring 5.

The curve of the pressure surface on the pressure member 4 can obviously be selected such that the door 9 is moved only at a desired angle, e.g. of 10°, to the closing plane.

Figure 6:
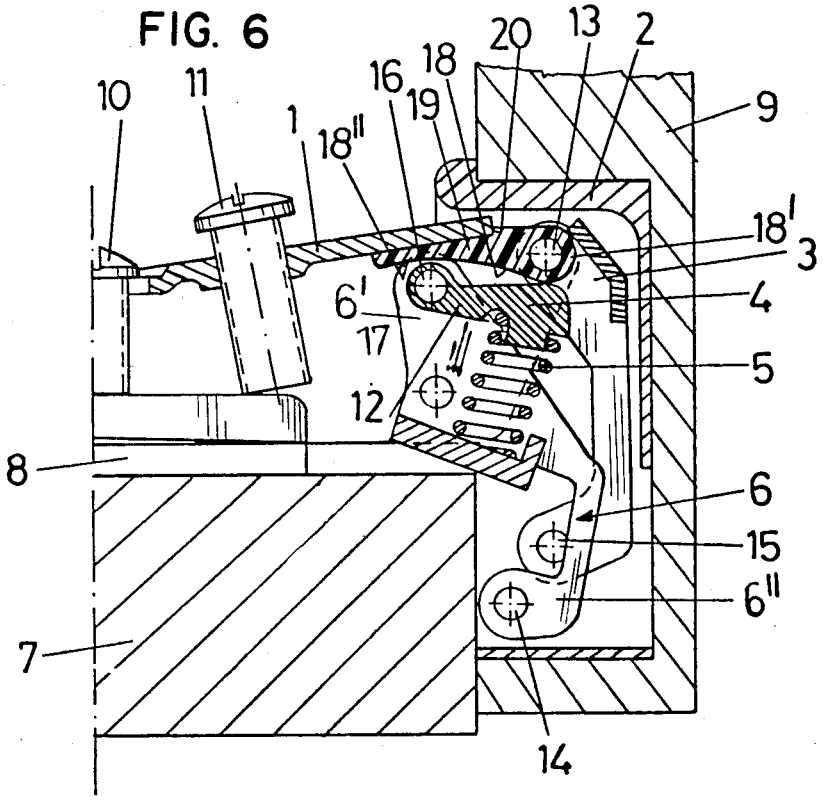
FIG. 6 is a sectional view of a further embodiment of a hinge according to the invention, shown in the closed position.
Figure 7:
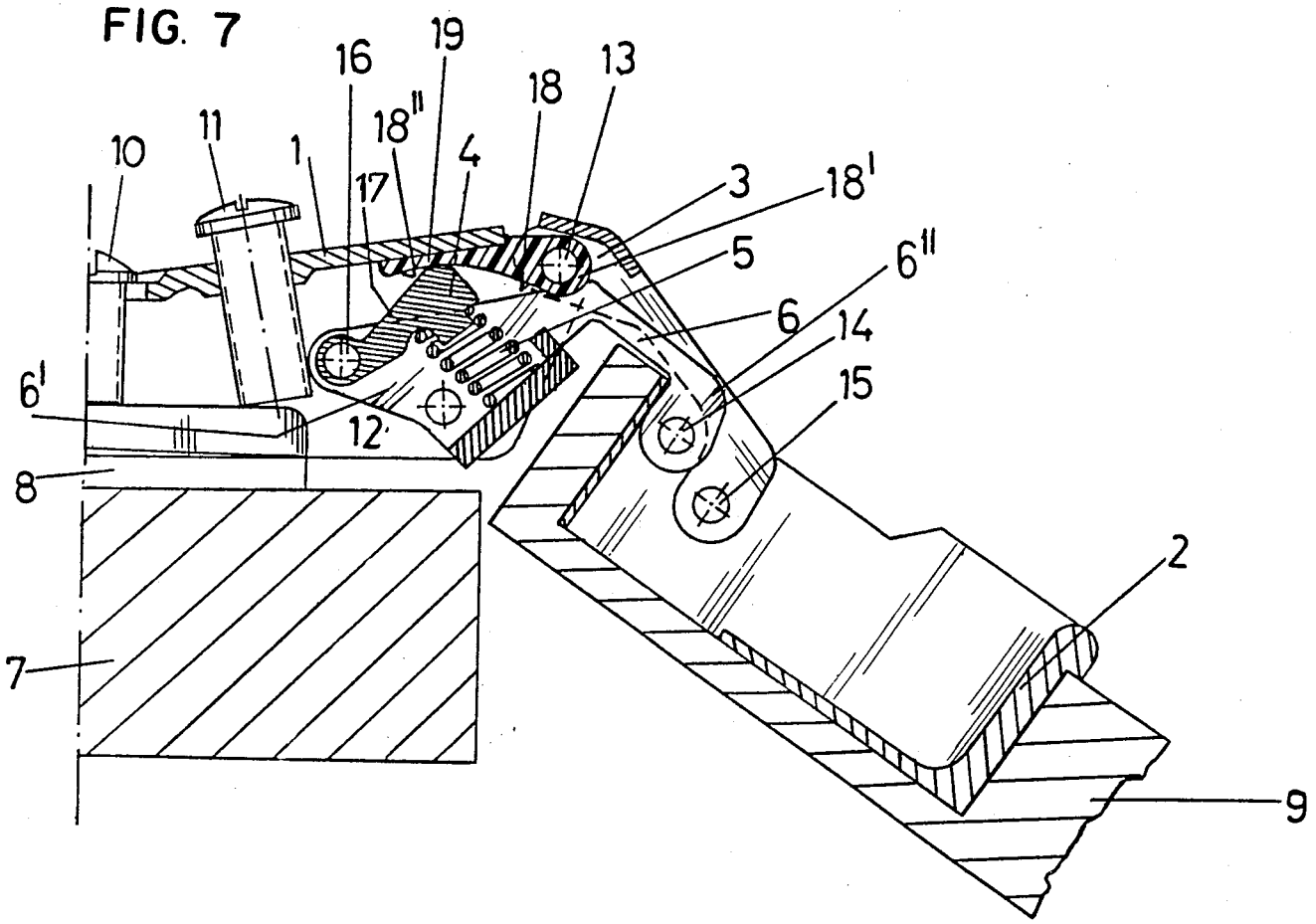
FIG. 7 is a similar sectional view of the hinge of FIG. 6, shown in the open position.
Figure 8:
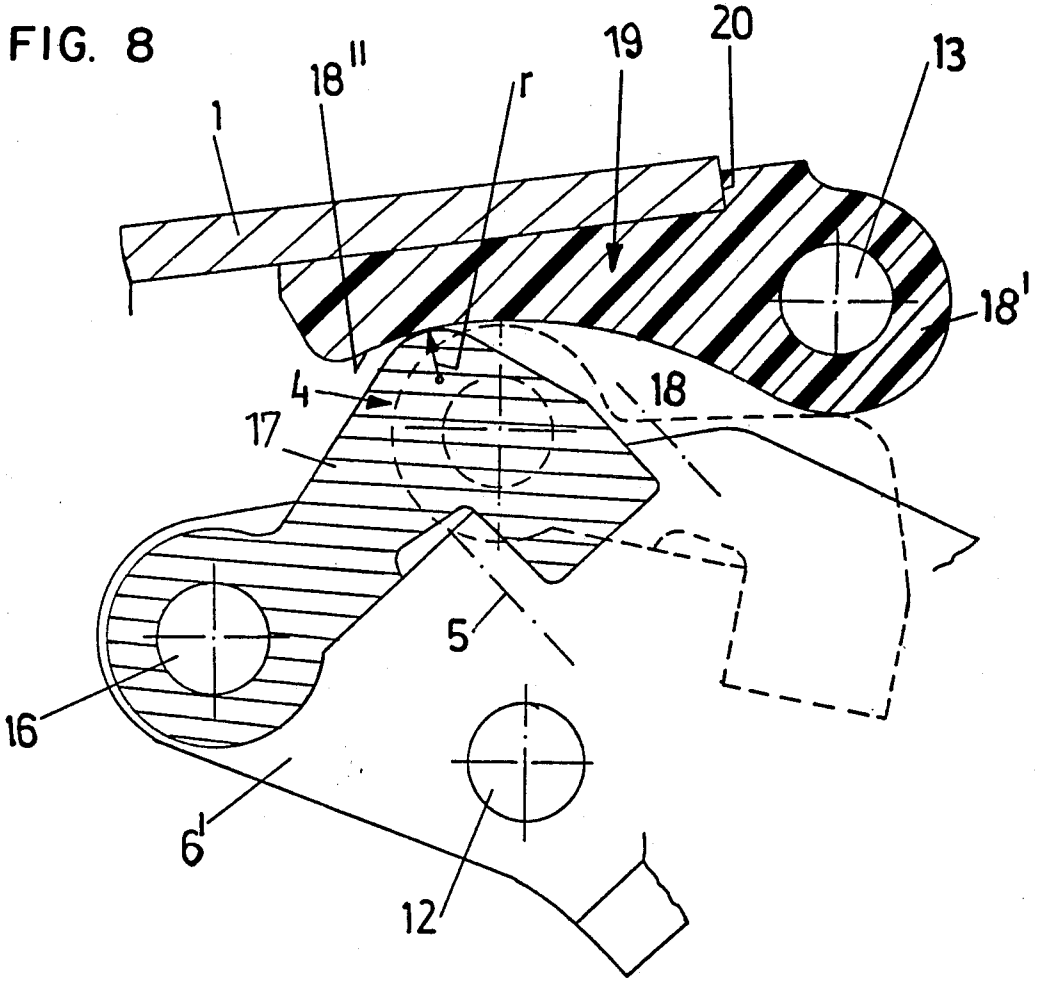
FIG 8 is a sectional view of an insert member and a pressure member.

In the embodiment according to FIGS. 6, 7, 8 a separate insert member 19 of plastic material with a closing region 18' and an opening region 18'' is provided on the hinge arm, the pressure member 4 pressing against such insert member. The insert member 19 is mounted on the hinge axle 13 and abuts on an edge 20 of the hinge arm 1.

Due to the arrangement according to the invention of the insert member 19, the pressure member 4 abuts on the same structural member in the closed position of the door 9 (as shown in FIG. 6) as in the opened position (FIG. 7).

When the door is opened and closed, the pressure member 4 moves along the pressure surface 18. There again, no load is taken from the pressure spring 5, i.e. the pressure member 4 and the pressure spring 5 are equally tensioned.

The curve of the pressure surface 18 at the insert member 19 can obviously be selected such that the door 9 is moved only at a desired angle, e.g. of 10°, to the closing plane. Hinges may also be provided with different insert members 19 with differently contoured pressure surfaces 18. In this manner, different closing angles are obtained without necessitating any changes of the hinge arm as such.

Figure 4:
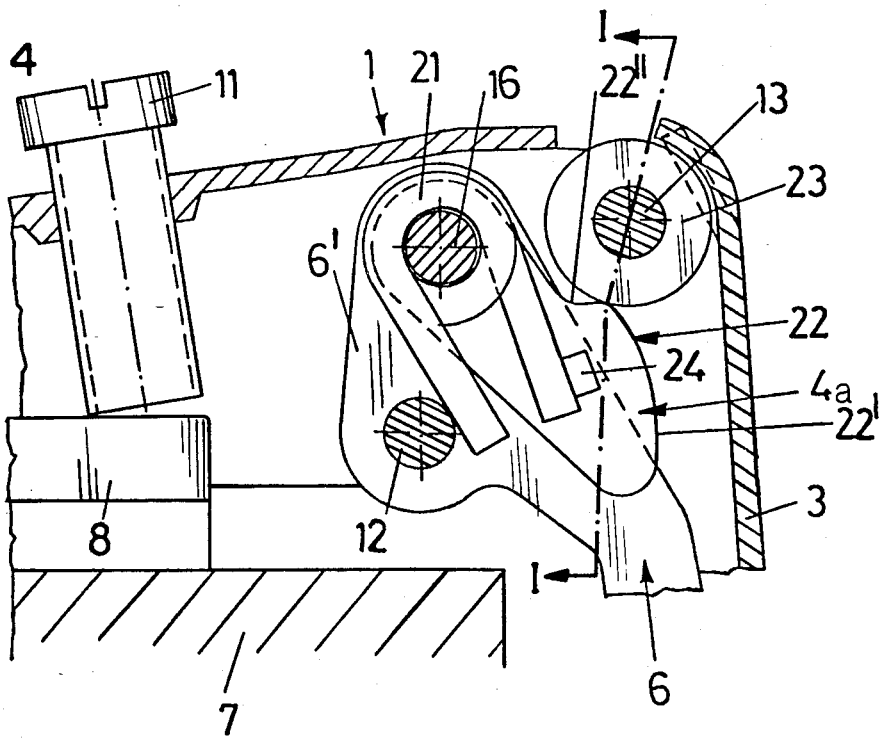
FIG. 4 is a sectional view similar to FIG. 3 of a third embodiment of the invention.
Figure 5:
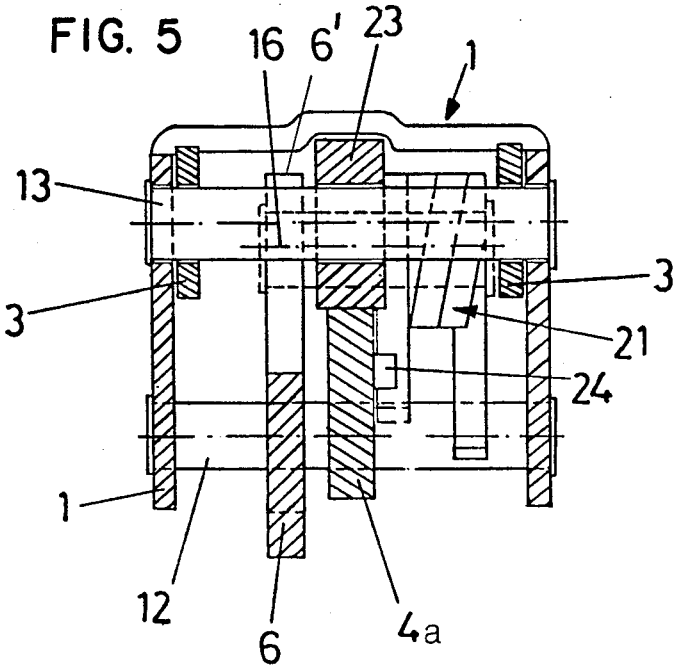
FIG. 5 is a sectional view along line I—I of FIG. 4.

The closing mechanism in the embodiment according to FIGS. 4 and 5 has a leg spring 21 which, on the one side, abuts against the hinge axle 12 of the internal hinge link 6 on the hinge arm 1 and, on the other side, abuts against a pressure member 4*a*.

The pressure member 4*a* like the leg spring 21, is hingedly connected with the internal hinge link 6.

The pressure member 4*a* has a moving surface 22 which forms a curved guide for the closing pressure. Moving surface 22 comprises two portions 22',22'' with oppositely directed curves. Portion 22' corresponds to the open position of the hinge. In the closed position the pressure point lies between the two portions 22', 22''.

The pressure member 4*a* abuts with its moving surface 22 on the hinge axle 13 of the external hinge link 3. A roller 23 is arranged around the hinge axle 13 to reduce the friction between the pressure member 4*a* and the hinge axle 13.

In this embodiment the pressure member 4*a* is provided with a lateral stop 24 for abutment with the leg spring 21.

Figure 3:
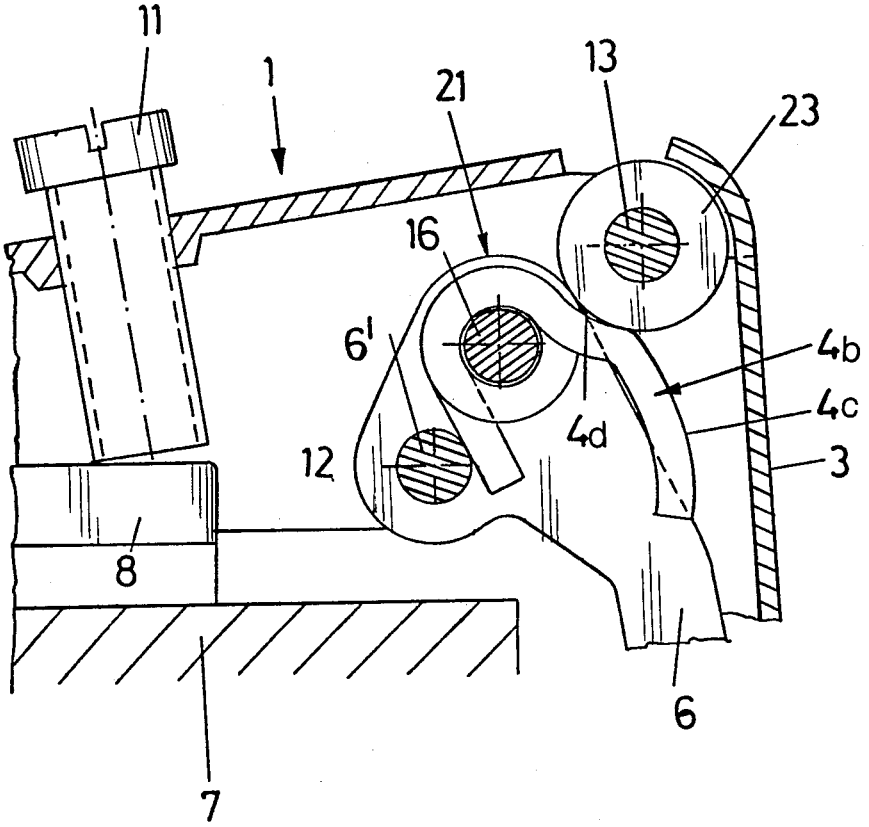
FIG. 3 is a sectional view of a hinge arm in the region of a closing mechanism according to a second embodiment of the invention.

In the embodiment according to FIG. 3, a separate pressure member is not provided. The leg spring 21, which is again mounted on a bolt 16 of the internal arm 6' of the hinge link 6, abuts directly on the hinge axles 12, 13 of the hinge arm 1. The hinge axle 13 of the external hinge link 3, on which the leg of the leg spring 21 designed as a pressure member 4*a* is displaced, is like in the afore-described embodiment provided with a roller 23 to reduce friction.

The leg of the leg spring 21 which forms the pressure member 4*a* has two curved portions 4*c*, and 4*d* respectively and with oppositely extending curves. The external curved portion 4*c* corresponds to the open position of the hinge. In the closed position the pressure point is between the roller 23 of the hinge axle 13 and a position between the portion 4*c* and the portion 4*d* of the leg of the leg spring 21 designed as the pressure member 4*b*.

In FIGS. 3, 4 the hinge is shown in the closed position.

What is claimed is:

1. A furniture door hinge including a closing mechanism, said hinge comprising:

a hinge casing adapted to be mounted on a door;

a hinge arm adapted to be mounted on a furniture wall;

inner and outer hinge links having respective first ends pivotally mounted to said hinge casing by respective outer hinge axles and respective second ends pivotally mounted to said hinge arm by respective inner hinge axles, thereby forming a quadrangular linkage;

said inner hinge link being in the form of a two-arm lever including a first arm extending between the respective said outer and inner hinge axles and a second arm extending from said respective inner hinge axle in a direction away from said respective outer hinge axle;

said hinge arm having a guide surface;

a pressure member extending between the inner hinge axles and being directly pivotally mounted on an axle fixed to said second arm at a position spaced from said respective inner hinge axle, said pressure member having a contact surface; and separate spring means for biasing said pressure member to pivot about said axle in a direction to urge said contact surface into direct abutment with a surface on the respective said inner hinge axle of said outer hinge link and in a direction toward said respective inner hinge axle of said outer hinge link in the closed position of the hinge and to urge said contact surface directly against said guide surface at all other positions of the hinge, said spring means comprising a compression coil spring compressed between said first arm and said pressure member.

2. A hinge as claimed in claim 1, wherein said second arm of said inner hinge link extends into said hinge arm.

3. A hinge as claimed in claim 1, wherein said guide surface is defined on a separate insert member mounted on said hinge arm, said insert member extending over the total path of displacement of said pressure member during opening and closing of the door.

4. A hinge as claimed in claim 3, wherein said insert member extends around said inner hinge axle of said outer hinge link to define said surface on said inner hinge axle.

5. A hinge as claimed in claim 4, wherein said insert member includes a step abutting an edge of said hinge arm.

6. A hinge as claimed in claim 3, wherein said insert member is formed of a plastic material.

7. A hinge as claimed in claim 3, wherein said guide surface is formed by two oppositely directed curved portions defining a single curved surface.

* * * * *